US010060437B2

(12) United States Patent
Cen

(10) Patent No.: US 10,060,437 B2
(45) Date of Patent: Aug. 28, 2018

(54) MULTIPLE SHAKING-HEAD STRUCTURE FOR FAN

(71) Applicant: ZHEJIANG JOYO ELECTRIC APPLIANCE TECHNOLOGY CO., LTD., Cixi, Zhejiang Province (CN)

(72) Inventor: Daiyu Cen, Zhejiang Province (CN)

(73) Assignee: ZHEJIANG JOYO ELECTRIC APPLIANCE TECHNOLOGY CO., LTD., Cixi (CN)

( * ) Notice: Subject to any disclaimer, the term of this patent is extended or adjusted under 35 U.S.C. 154(b) by 532 days.

(21) Appl. No.: 14/851,810

(22) Filed: Sep. 11, 2015

(65) Prior Publication Data

US 2016/0298634 A1 Oct. 13, 2016

(30) Foreign Application Priority Data

Apr. 10, 2015 (CN) ..... 2015 2 02114083 U

(51) Int. Cl.
*F04D 25/10* (2006.01)
*F04D 19/00* (2006.01)
*F04D 29/64* (2006.01)

(52) U.S. Cl.
CPC ..... *F04D 25/105* (2013.01); *F04D 19/002* (2013.01); *F04D 29/646* (2013.01)

(58) Field of Classification Search
CPC ..... F04D 25/105; F04D 19/002
USPC ..... 416/100
See application file for complete search history.

(56) References Cited

U.S. PATENT DOCUMENTS 2,313,481 A * 3/1943 Rendano ..... F04D 25/105 416/100
2,634,905 A * 4/1953 Reisch ..... F04D 25/105 416/100
4,626,123 A * 12/1986 Brown ..... E04B 1/1906 248/160
5,556,256 A * 9/1996 Shao ..... F04D 25/105 403/141

(Continued)

*Primary Examiner* — Timothy L Maust
(74) *Attorney, Agent, or Firm* — Jiwen Chen

(57) ABSTRACT

The present invention discloses a multiple shaking-head structure for a fan, comprising a front part of the fan, a shaking-head upper cover, a synchronous motor, a gear stand and a fixed frame, wherein the front part of the fan consists of a motor front cover, a motor and a motor rear cover; a first elastic clamp which has a first dentation structure is positioned on the motor rear cover; first springs and a first ball tack are positioned in the shaking-head upper cover, wherein the first ball tack is matched with the first dentation structure; the synchronous motor is positioned on a synchronous motor support, and a driving gear is fixed on the synchronous motor; a circle of annular gear is positioned in a disc above the gear stand, and the driving gear is engaged with the annular gear of the gear stand; a second elastic clamp is positioned below the disc of the gear stand and has a second dentation structure; and a second spring and a second ball tack are positioned on the side surface of the fixed frame, wherein the second ball tack is matched with the second dentation structure. The present invention integrates the function of adjusting by 90 degrees up and down, the function of large-angle head-shaking and the function of adjusting by 90 degrees left and right, so that the fan can achieve all-directional rotation and all-directional air-out.

2 Claims, 4 Drawing Sheets

(56) References Cited

U.S. PATENT DOCUMENTS

| | | | | | |
|---|---|---|---|---|---|
| 6,000,910 | A * | 12/1999 | Ahn | ..... | F04D 25/105<br>416/100 |
| 6,015,262 | A * | 1/2000 | Huang | ..... | F04D 25/105<br>403/344 |
| 9,702,369 | B2 * | 7/2017 | Lee | ..... | F04D 25/105 |

* cited by examiner

MULTIPLE SHAKING-HEAD STRUCTURE FOR FAN

The present invention claims the priority benefit of Chinese Application No. 2015202114083, filed Apr. 10, 2015, which is hereby incorporated by reference.

TECHNICAL FIELD

The present invention relates to a shaking-head structure for an electric fan, in particular to a multiple shaking-head structure for a fan.

BACKGROUND ART

At present, commercially available fans generally swing by a certain angle in a basically horizontal direction. Whereas owing to the structural limitation, the swing angle is unlikely to be large. No matter how the fan swings, its air-out directions face people in a small angle range, and if several people reside in different azimuths of one room in the office or at home, multiple fans from different directions are required to achieve temperature drop.

SUMMARY

The present invention aims at solving said problems and an object thereof is to provide a multiple angle shaking-head structure which is capable of adjusting the direction of the fan randomly, ensuring that the fan rotates without dead angles, and achieving all-directional air-out.

Therefore, the technical solution of the present invention lies in that: the multiple shaking-head structure for the fan comprises a motor front cover, a motor and a motor rear cover, wherein the motor is positioned between the motor front cover and the motor rear cover and is fixed by screws; the multiple shaking-head structure is characterized by also comprising a shaking-head upper cover, a synchronous motor, a synchronous motor support, a driving gear, a gear stand, a fixed frame and a rotating shaft pressing plate; a cylindrical bulge is positioned behind the motor rear cover, and a cylindrical through hole is formed in the middle of the cylindrical bulge; a first elastic clamp which is of an annular sector structure is fixed on the cylindrical bulge of the motor rear cover, and a first dentation structure is positioned on the arc surface of the annular sector structure; a groove is formed in an upper side of the shaking-head upper cover, and the cylindrical bulge of the motor rear cover is arranged in the groove of the shaking-head upper cover and is fixed by a screw rod; the groove of the shaking-head upper cover is internally equipped with two first springs, wherein a first ball tack is arranged above the first springs; the first ball tack is matched with the first dentation structure of the first elastic clamp; the synchronous motor is arranged on the synchronous motor support the section of which is of a T-shaped structure, and the synchronous motor support is fixed on the shaking-head upper cover by means of screws; a motor shaft of the synchronous motor penetrates through the synchronous motor support to fix the driving gear; the gear stand has a T-shaped section, a disc is positioned above the gear stand and a hollow cylinder is positioned below the gear stand; the inner wall of the disc of the gear stand has a circle of annular gear, the synchronous motor support is placed in the gear stand, and the driving gear on the motor shaft of the synchronous motor is engaged with the annular gear of the gear stand; a second elastic clamp which is of an annular sector structure is positioned below the disc of the gear stand, and a second dentation structure is positioned on the plane of the bottom; the hollow cylinder below the gear stand penetrates through the fixed frame and is fixed by means of the rotating shaft pressing plate and screws; a cylindrical hole is formed in the side surface of the fixed frame, a second spring is positioned in the cylindrical hole, and a second ball tack is positioned on the second spring; and the second ball tack is matched with the second dentation structure on the plane of the second elastic clamp.

Further, the central angles of both the first elastic clamp and the second elastic clamp, which are of the annular sector structure, are 90 degrees, respectively.

According to the present invention, the motor front cover, the motor and the motor rear cover constitute the front part of the fan, and the motor rear cover is fixed on the shaking-head upper cover by a screw rod to integrally constitute the head of the fan; the first elastic clamp on the motor rear cover is matched with the first ball tack on the shaking-head upper cover, so that the front part of the fan can rotate in a manner of pitching by 90 degrees up and down around the screw rod relative to the shaking-head upper cover; the synchronous motor and the synchronous motor support are fixed below the shaking-head upper cover through screws, and when the synchronous motor drives the driving gear on the motor shaft to rotate, the head of the fan can do a large-angle head-shaking movement relative to the gear stand by means of the engagement of the driving gear and the annular gear on the gear stand; and the second elastic clamp below the gear stand is matched with the second ball tack on the fixed frame, so that the gear stand rotates in a manner of head-shaking by 90 degrees left and right relative to the fixed frame together with the head of the fan. The present invention integrates the function of adjusting by manually pitching by 90 degrees up and down, the active large-angle head-shaking function and the function of adjusting by manually head-shaking by 90 degrees left and right to constitute a set of brand-new shaking-head mechanism, so that a user can adjust the all-directional rotation randomly so as to achieve the purpose of blowing everywhere and all-directional air-out.

BRIEF DESCRIPTION OF THE DRAWINGS

The present invention is further described in detail as below in conjunction with the attached drawings and the embodiments of the present invention.

THE SPECIFIC EMBODIMENTS OF THE INVENTION

Figure 1:
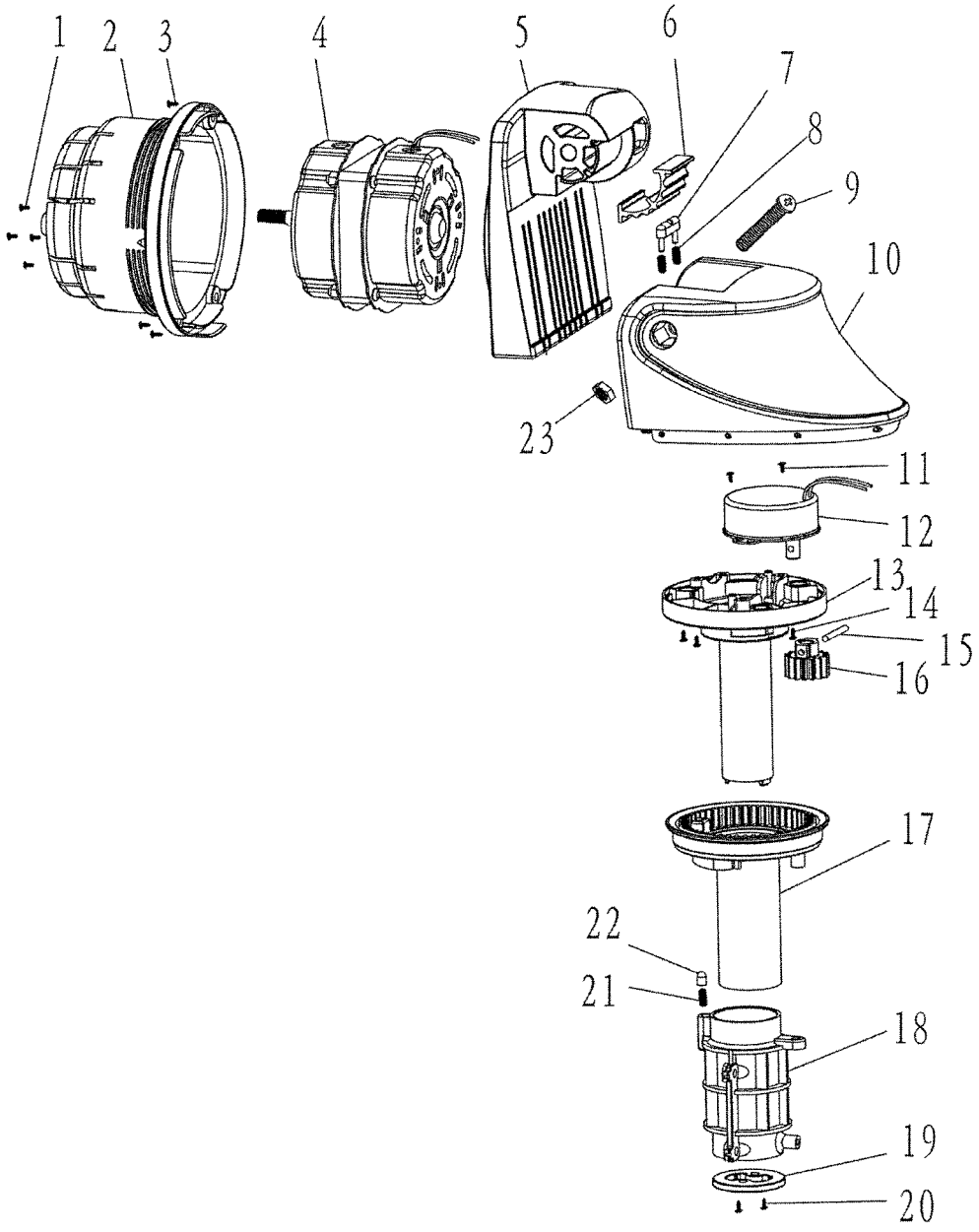
FIG. 1 is a structural exploded view of the present invention.
Figure 2:
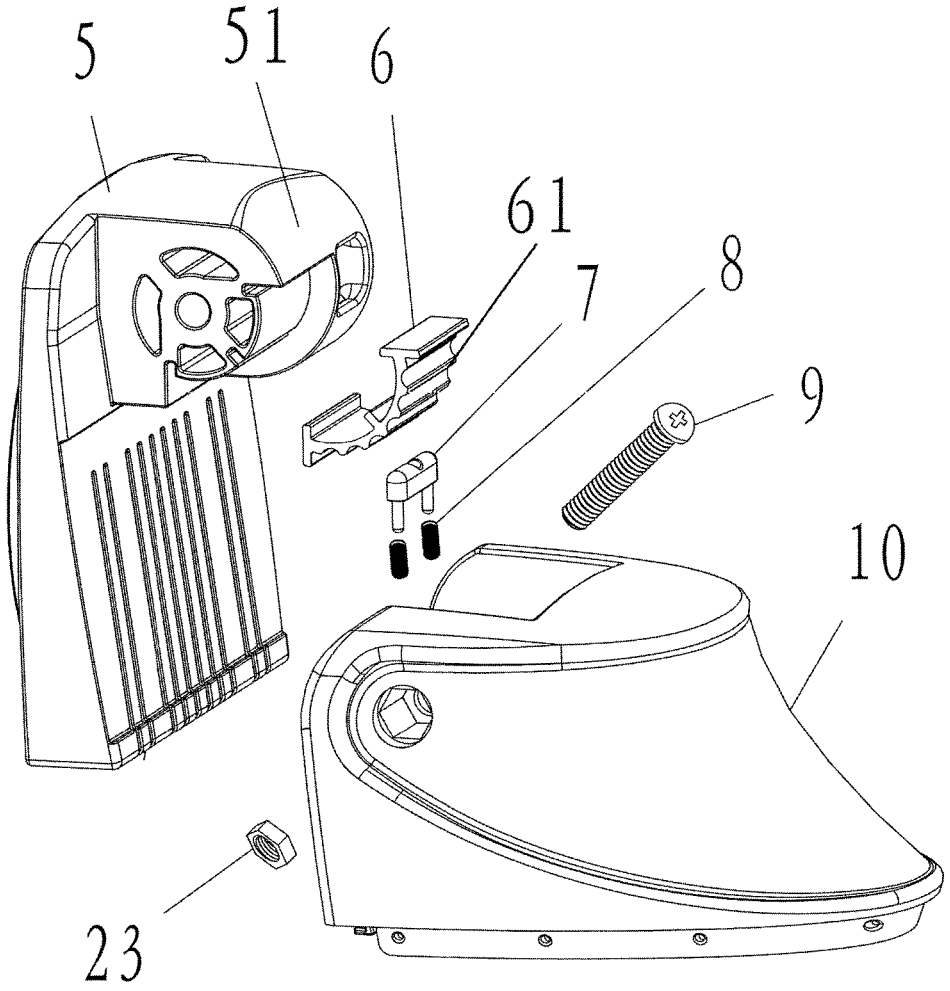
FIG. 2 is a schematic drawing of the up-down pitching structure of the present invention.
Figure 3:
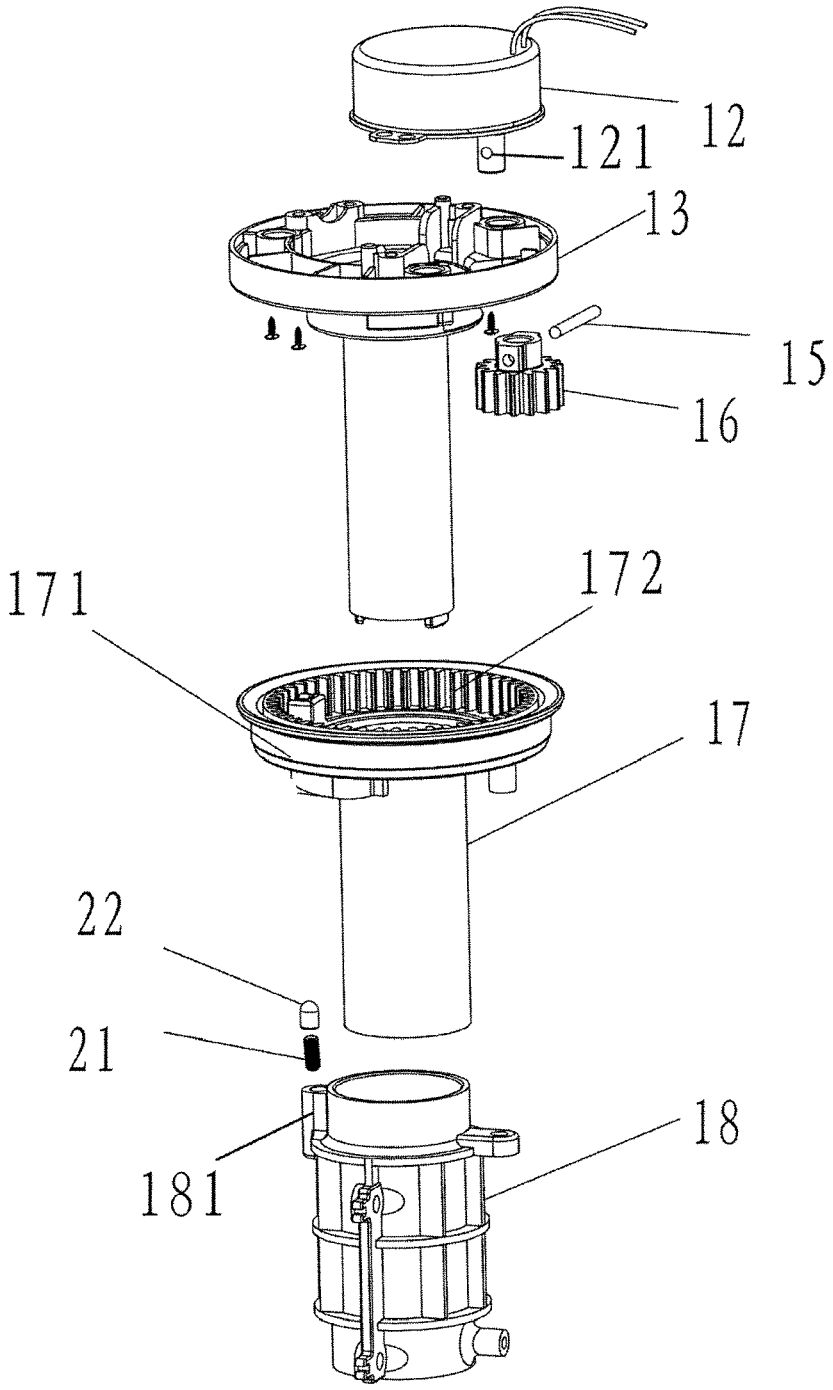
FIG. 3 is a schematic drawing of the left-right head-shaking structure of the present invention.
Figure 4:
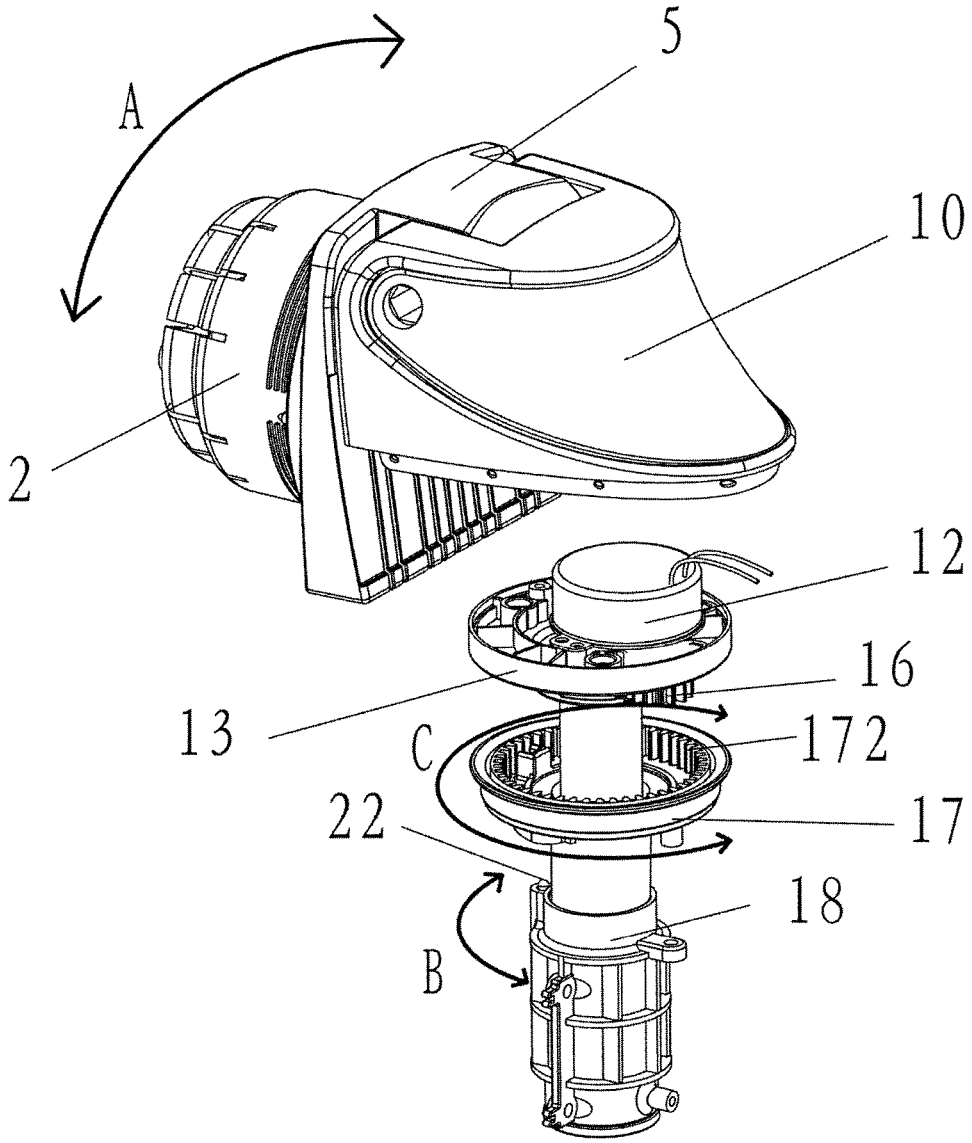
FIG. 4 is a working schematic drawing of the present invention.

The embodiment, referring to the attached drawings, comprises a motor front cover 2, a motor 4 and a motor rear cover 5, wherein the motor 4 is positioned between the motor front cover 2 and the motor rear cover 5 and is fixed by means of first screws 1; the embodiment also comprises a shaking-head upper cover 10, a synchronous motor 12, a synchronous motor support 13, a driving gear 16, a gear stand 17, a fixed frame 18 and a rotating shaft pressing plate 19; a cylindrical bulge 51 is positioned behind the motor rear cover 5, and a cylindrical through hole is formed in the middle of the cylindrical bulge 51; a first elastic clamp 6 is fixed on the cylindrical bulge 51 of the motor rear cover 5; the first elastic clamp 6 is of an annular sector structure, and a first dentation structure 61 is positioned on an arc surface of the annular sector structure of the first elastic clamp 6; a groove is formed in the upper side of the shaking-head upper cover 10, and the cylindrical bulge 51 of the motor rear cover 5 is placed in the groove of the shaking-head upper cover 10 and is fixed by a screw rod 9; two first springs 8 are arranged in the groove of the shaking-head upper cover 10, and a first ball tack 7 is arranged above the first springs 8; the first ball tack 7 is matched with the first dentation structure 61 of the first elastic clamp 6; the synchronous motor 12 is placed on the synchronous motor support 13 of which the section is of a T-shaped structure, and the synchronous motor support 13 is fixed on the shaking-head upper cover 10 through fourth screws 14; a motor shaft 121 of the synchronous motor 12 penetrates through the synchronous motor support 13 to fix a driving gear 16; the gear stand 17 has a T-shaped section, wherein a disc 171 is positioned above the gear stand and a hollow cylinder is positioned below the gear stand; a circle of annular gear 172 is formed on the inner wall of the disc 171 of the gear stand 17, the synchronous motor support 13 is positioned in the gear stand 17 and the driving gear 16 on the motor shaft 121 of the synchronous motor 12 is engaged with the annular gear 172 of the gear stand 17; a second elastic clamp which is of an annular sector structure is positioned below the disc 171 of the gear stand 17, and a second dentation structure is positioned on the plane of the bottom; the hollow cylinder below the gear stand 17 penetrates through the fixed frame 18 and is fixed by means of the rotating shaft pressing plate 19 and fifth screws 20; a cylindrical hole 181 is formed in the side surface of the fixed frame 18, a second spring 21 is positioned inside the cylindrical hole 181, and a second ball tack 22 is positioned on the second spring 21; the second ball tack 22 is matched with the second dentation structure on the plane of the second elastic clamp; and the central angles of both the first elastic clamp 6 and the second elastic lamp, which are of the annular sector structure, are 90 degrees, respectively.

The embodiment is installed according to the following steps:

The first step: putting the motor 4 to the motor front cover 2 and enabling the first screws 1 to penetrate through the motor front cover 2 and to be fastened on the motor 4 to constitute the front part of the fan;

The second step: sheathing the front part of the fan into the motor rear cover 5, enabling the second screws 3 to penetrate through the motor front cover 2 and to be fastened on the motor rear cover 5, and sheathing the first elastic clamp 6 into the motor rear cover 5 to constitute the head of the fan;

The third step: enabling the first ball tack 7 to penetrate through the first springs 8 to be placed in the hole of the shaking-head upper cover 10, pressing the head of the fan into the shaking-head upper cover 10, putting a nut 23 into a side hole of the shaking-head upper cover 10, and enabling the screw rod 9 to penetrate through the shaking-head upper cover 10 and the head of the fan to be locked with the nut 23 to constitute the head which can rotate in a manner of manually pitching by 90 degrees up and down, wherein the rotation direction is shown as an arrow A;

The fourth step: sheathing the synchronous motor 12 onto the synchronous motor support 13, and enabling the third screws 11 to penetrate through the synchronous motor 12 and to be fastened on the synchronous motor support 13; and sheathing the driving gear 16 onto the synchronous motor 12 and to be fastened on the synchronous motor 12 through enabling a positioning pin 15 to penetrate through the driving gear 16 to constitute a driving gear holder;

The fifth step: sequentially putting the second spring 21 and the second ball tack 22 into a cylindrical hole 181 in the side surface of the fixed frame, and pressing the gear stand 17 to the fixed frame 18 to constitute a pedestal which is capable of head-shaking by 90 degrees manually left and right, wherein the head-shaking direction is shown as an arrow B;

The sixth step: putting the driving gear holder assembled in the fourth step to the pedestal, capable of head-shaking by 90 degrees left and right, assembled in the fifth step, and sheathing the rotating shaft pressing plate 19 onto the gear stand 17, and enabling the fifth screws 20 to penetrate through the rotating shaft pressing plate 19 and to be fastened on the gear stand 17, so as to constitute a big pedestal which is capable of head-shaking actively at a large angle and head-shaking by 90 degrees manually left and right, wherein the large-angle head-shaking direction is shown as an arrow C; and The seventh step: sheathing the big pedestal assembled in the sixth step onto the head, capable of pitching by 90 degrees manually up and down, assembled in the third step, and enabling the fourth screws 14 to penetrate through the synchronous motor support 13 and to be fastened on the shaking-head upper cover 10, thus finishing the structural assembly.

The invention claimed is:

1. A multiple angle shaking-head structure for a fan comprising: a motor front cover, a motor and a motor rear cover, wherein the motor is positioned between the motor front cover and the motor rear cover and is fixed by screws; the multiple angle shaking-head structure is characterized by also comprising a shaking-head upper cover, a synchronous motor, a synchronous motor support, a driving gear, a gear stand, a fixed frame and a rotating shaft pressing plate; a cylindrical bulge is positioned behind the motor rear cover, and a cylindrical through hole is formed in the middle of the cylindrical bulge; a first elastic clamp which is of an annular sector structure is fixed on the cylindrical bulge of the motor rear cover, and a first dentation structure is positioned on an arc surface of the annular sector structure; a groove is formed in an upper side of the shaking-head upper cover, and the cylindrical bulge of the motor rear cover is arranged in the groove of the shaking-head upper cover and is fixed by a screw rod; the groove of the shaking-head upper cover is internally equipped with two first springs, wherein a first ball tack is arranged above the first springs; the first ball tack is matched with the first dentation structure of the first elastic clamp; the synchronous motor is positioned on the synchronous motor support, the section of the synchronous motor support is of a T-shaped structure, and the synchronous motor support is fixed on the shaking-head upper cover by means of screws; a motor shaft of the synchronous motor penetrates through the synchronous motor support to fix the driving gear; the gear stand has a T-shaped section, a disc is positioned above the gear stand and a hollow cylinder is positioned below the gear stand; the inner wall of the disc of the gear stand has a circle of annular gear, the synchronous motor support is placed in the gear stand, and the driving gear on the motor shaft of the synchronous motor is engaged with the annular gear of the gear stand; a second elastic clamp which is of an annular sector structure is positioned below the disc of the gear stand, and a second dentation structure is positioned on the plane of the bottom; the hollow cylinder below the gear stand penetrates through the fixed frame and is fixed by means of the rotating shaft pressing plate and screws; a cylindrical hole is formed in the side surface of the fixed frame, a second spring is positioned in the cylindrical hole, and a second ball tack is positioned on the second spring; and the second ball tack is matched with the second dentation structure on the plane of the second elastic clamp.

2. The multiple angle shaking-head structure for the fan according to the claim 1, wherein: the central angles of both the first elastic clamp and the second elastic clamp, which are of the annular sector structure, are 90 degrees, respectively.

* * * * *